US008884996B2

(12) United States Patent
Teranishi et al.

(10) Patent No.: US 8,884,996 B2
(45) Date of Patent: Nov. 11, 2014

(54) DISPLAY DEVICE AND ELECTRONIC UNIT HAVING A PLURALITY OF POTENTIAL LINES MAINTAINED AT GRAY-SCALE POTENTIALS

(75) Inventors: Yasuyuki Teranishi, Aichi (JP); Hideyuki Omori, Aichi (JP)

(73) Assignee: Japan Display West Inc., Chita-gun, Aichi-ken (JP)

( * ) Notice: Subject to any disclaimer, the term of this patent is extended or adjusted under 35 U.S.C. 154(b) by 281 days.

(21) Appl. No.: 13/408,588

(22) Filed: Feb. 29, 2012

(65) Prior Publication Data

US 2012/0249606 A1 Oct. 4, 2012

(30) Foreign Application Priority Data

Mar. 29, 2011 (JP) ..... 2011-073077

(51) Int. Cl.

| | |
|---|---|
| ***G09G 5/10*** | (2006.01) |
| ***G09G 3/36*** | (2006.01) |
| ***G09G 3/20*** | (2006.01) |

(52) U.S. Cl.

CPC ..... *G09G 3/2074* (2013.01); *G09G 2300/0857* (2013.01); *G09G 3/3648* (2013.01); *G09G 3/3607* (2013.01); *G09G 2330/08* (2013.01); *G09G 2320/0223* (2013.01); *G09G 2300/0426* (2013.01)

USPC ..... 345/690; 345/89

(58) Field of Classification Search

CPC ..... G06G 3/3648; G06G 2320/0276

USPC ..... 345/690, 89

See application file for complete search history.

(56) References Cited

U.S. PATENT DOCUMENTS

| | | | | |
|---|---|---|---|---|
| 2001/0033259 | A1 * | 10/2001 | Sakaguchi | 345/87 |
| 2009/0091579 | A1 * | 4/2009 | Teranishi et al. | 345/530 |
| 2009/0128585 | A1 * | 5/2009 | Shimodaira | 345/690 |
| 2009/0231268 | A1 * | 9/2009 | Yamada | 345/107 |
| 2010/0109990 | A1 * | 5/2010 | Harada | 345/87 |
| 2011/0032279 | A1 * | 2/2011 | Kim et al. | 345/690 |

FOREIGN PATENT DOCUMENTS

| | | |
|---|---|---|
| JP | 08-286170 | 11/1996 |
| JP | 2001-282168 | 10/2001 |
| JP | 2004-139970 | 5/2004 |
| JP | 2005-099414 | 4/2005 |
| JP | 2007-147932 | 6/2007 |
| JP | 2008-058853 | 3/2008 |

OTHER PUBLICATIONS

Japanese Office Action issued Sep. 24, 2014 in corresponding Japanese Patent Application No. 2011-073077.

* cited by examiner

*Primary Examiner* — Long D Pham

(74) *Attorney, Agent, or Firm* — K&L Gates LLP

(57) ABSTRACT

A display device includes: pixels each including a display element; potential lines maintained at respective gray-scale potentials different from one another, the potential lines including first potential lines each maintained at a first gray-scale potential level allowing a luminance gradient to be relatively steep and second potential lines each maintained at a second gray-scale potential level allowing a luminance gradient to be relatively gentle, the luminance gradient representing a magnitude of a display luminance variation caused by a variation in a voltage or current applied to the display element; and a driving section performing display drive on the pixels based on an image signal, through supplying the display element of each of the pixels with a gray-scale potential level of selected one of the plurality of potential lines. A resistance of the first potential line is lower than a resistance of the second potential line.

17 Claims, 13 Drawing Sheets

| SH | SL | 20H | 20L | GRAY-SCALE | DISPLAY LUMINANCE |
|---|---|---|---|---|---|
| L | L | BLACK | BLACK | 0 | LOW (BLACK) |
| | H | BLACK | WHITE | 1 | ↓ |
| H | L | WHITE | BLACK | 2 | ↓ |
| | H | WHITE | WHITE | 3 | HIGH (WHITE) |

FIG. 11

FIG. 12A RB(H) < RB(L) < RW(H) < RW(L)
(e. g. Wb(H) > Wb(L) > Ww(H) > Ww(L))

FIG. 12B RB(H) < RB(L) < RW(H) = RW(L)
(e. g. Wb(H) > Wb(L) > Ww(H) = Ww(L))

FIG. 12C RB(H) = RB(L) < RW(H) = RW(L)
(e. g. Wb(H) = Wb(L) > Ww(H) = Ww(L))

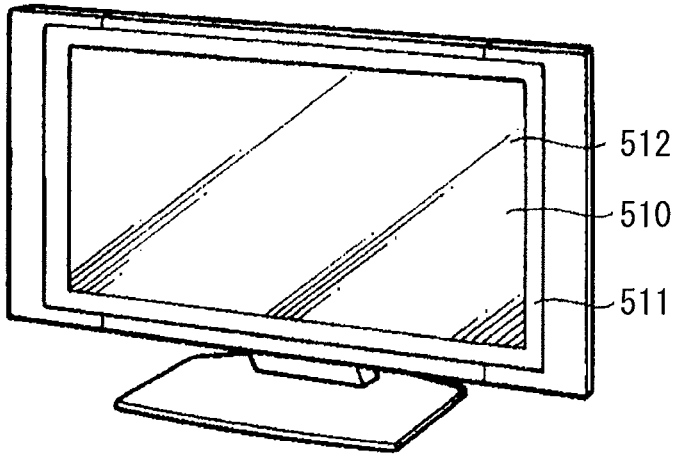
FIG. 13
FIG. 14A
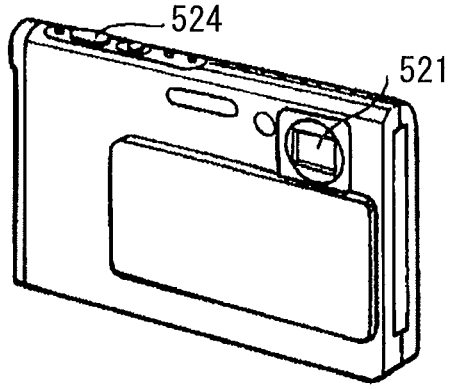
FIG. 14B
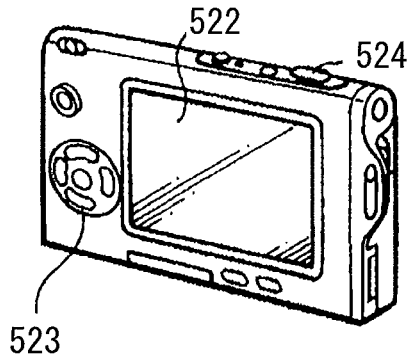

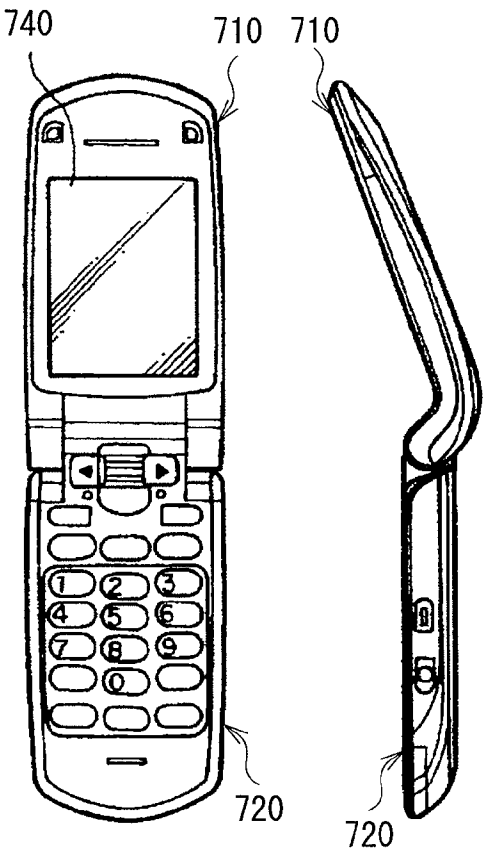
FIG. 17A
FIG. 17B
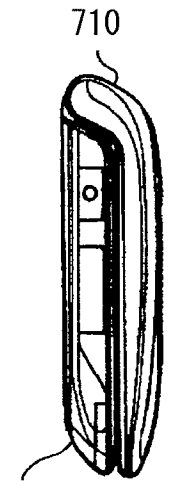
FIG. 17D
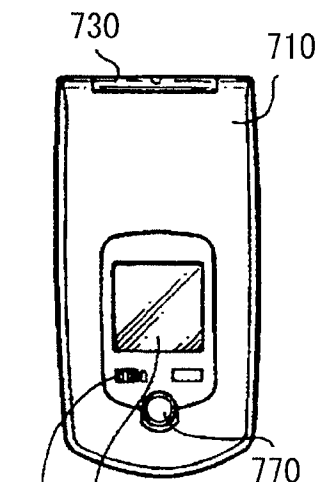
FIG. 17C
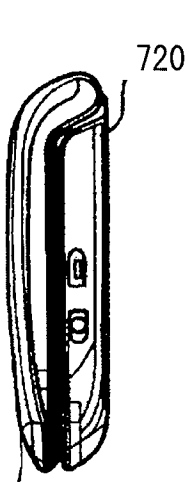
FIG. 17E
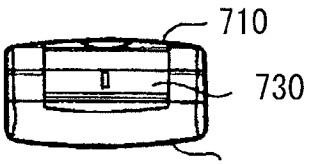
FIG. 17F
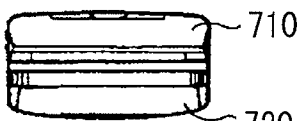
FIG. 17G

DISPLAY DEVICE AND ELECTRONIC UNIT HAVING A PLURALITY OF POTENTIAL LINES MAINTAINED AT GRAY-SCALE POTENTIALS

CROSS REFERENCES TO RELATED APPLICATIONS

The present application claims priority to Japanese Priority Patent Application JP 2011-073077 filed in the Japan Patent Office on Mar. 29, 2011, the entire content of which is hereby incorporated by reference.

BACKGROUND

The present disclosure relates to a display device which performs image display using plural types of potential lines each of which is maintained at a gray-scale potential, and to an electronic unit provided with the display device.

Display devices using various types of display elements such as liquid crystal elements and organic EL (Electro Luminescence) elements have been developed. In each of the display devices, a peripheral circuit is typically arranged in a frame region (non-display region) located at an outer edge (outer circumference) of a display region (effective display region) having a plurality of pixels. The peripheral circuit includes, for example, a driving circuit which drives a plurality of pixels. Examples of the driving circuit include a scanning line driving circuit which sequentially drives a plurality of pixels, and a signal line driving circuit which supplies an image signal to a pixel to be driven.

Further, in recent years, a display device in which a certain pixel circuit (storage circuit, for example) is formed in each pixel is being proposed (for example, see Japanese Unexamined Patent Application Publication No. H08-286170).

SUMMARY

However, with current increase in size and resolution of display devices, the display device, especially that which includes the pixel circuit as described above, is disadvantageous in that yield in manufacturing is reduced due to, for example, short circuit between electrodes resulting from foreign substances etc.

It is desirable to provide a display device and an electronic unit capable of increasing yield in manufacturing.

A display device according to an embodiment of the present disclosure includes: a plurality of pixels each including a display element; a plurality of potential lines maintained at respective gray-scale potentials different from one another, the potential lines including first potential lines each maintained at a first gray-scale potential level allowing a luminance gradient to be relatively steep and second potential lines each maintained at a second gray-scale potential level allowing a luminance gradient to be relatively gentle, the luminance gradient representing a magnitude of a display luminance variation caused by a variation in a voltage or current applied to the display element; and a driving section performing display drive on the pixels based on an image signal, through supplying the display element of each of the pixels with a gray-scale potential level of selected one of the plurality of potential lines. A resistance of the first potential line is lower than a resistance of the second potential line.

An electronic unit according to an embodiment of the present disclosure includes a display device, the display device including: a plurality of pixels each including a display element; a plurality of potential lines maintained at respective gray-scale potentials different from one another, the potential lines including first potential lines each maintained at a first gray-scale potential level allowing a luminance gradient to be relatively steep and second potential lines each maintained at a second gray-scale potential level allowing a luminance gradient to be relatively gentle, the luminance gradient representing a magnitude of a display luminance variation caused by a variation in a voltage or current applied to the display element; and a driving section performing display drive on the pixels based on an image signal, through supplying the display element of each of the pixels with a gray-scale potential level of selected one of the plurality of potential lines. A resistance of the first potential line is lower than a resistance of the second potential line.

In the display device and the electronic unit according to the embodiments of the present disclosure, the display drive is performed on the pixels based on the image signal, through supplying the display element of each of the pixels with the gray-scale potential level of selected one of the plurality of potential lines. Here, the resistance of the first potential line, maintained at the first gray-scale potential level that allows the luminance gradient to be relatively steep, is lower than the resistance of the second potential line maintained at the second gray-scale potential level that allows the luminance gradient to be relatively gentle. Hence, even when short circuit between electrodes resulting from such as foreign substances has caused a variation in the potential of the first potential line (the gray-scale potential that allows the luminance gradient to be relatively steep), it is possible to suppress occurrence of the variation in the display luminance of the display element to which the varied gray-scale potential of the first potential line is supplied.

In the display device and the electronic unit according to the embodiments of the present disclosure, the resistance of the first potential line, maintained at the first gray-scale potential level that allows the luminance gradient to be relatively steep, is lower than the resistance of the second potential line maintained at the second gray-scale potential level that allows the luminance gradient to be relatively gentle. Hence, even when the potential of the first potential line is varied, it is possible to suppress the variation in the display luminance of the display element to which the varied gray-scale potential of the first potential line is supplied. This makes it possible to avoid such as generation of line defects of pixels (defects of pixels along the first potential line) and generate only point defects, for example, improving yield in manufacturing.

It is to be understood that both the foregoing general description and the following detailed description are exemplary and are intended to provide further explanations of the technology as claimed.

Additional features and advantages are described herein, and will be apparent from the following Detailed Description and the figures.

BRIEF DESCRIPTION OF THE FIGURES

The accompanying drawings are included to provide a further understanding of the disclosure, and are incorporated in and constitute a part of this specification. The drawings illustrate embodiments and, together with the specification, serve to explain the principles of the technology.

FIG. 11 is a diagram illustrating a general outline of a gray-scale display operation in the pixel shown in FIG. 10.

FIGS. 12A to 12C are diagrams each illustrating examples of configurations of the black-potential line and the while potential line according to the second modification.

FIG. 13 is a perspective view illustrating an external appearance of a first application example of the display device according to any one of the embodiment and the modifications.

FIGS. 14A and 14B are perspective views illustrating external appearances of a second application example viewed from the front and from the back, respectively.

FIG. 17A is a front view of a fifth application example in an open state, FIG. 17B is a side view thereof in the open state, FIG. 17C is a front view thereof in a closed state, FIG. 17D is a left-side view thereof in the close state, FIG. 17E is a right-side view thereof in the close state, FIG. 17F is a top view thereof in the closed state, and FIG. 17G is a bottom view thereof in the closed state.

DETAILED DESCRIPTION

Hereinafter, an embodiment of the present disclosure will be described in detail with reference to the drawings. The descriptions will be made in the following sequence:

1. Embodiment (an example in which the resistances of the potential lines are made different from one another according to difference in the wiring width)
2. Modifications First Modification (an example in which the resistances of potential lines are made different from one another according to difference in materials (resistivity)) Second Modification (an example in which gray-scale display is performed using an image signal configured of a plurality of bits)

3. Application Examples (examples of application to electronic units)
4. Other Modifications

Embodiment

Entire Configuration of Display Device 1

Figure 1:
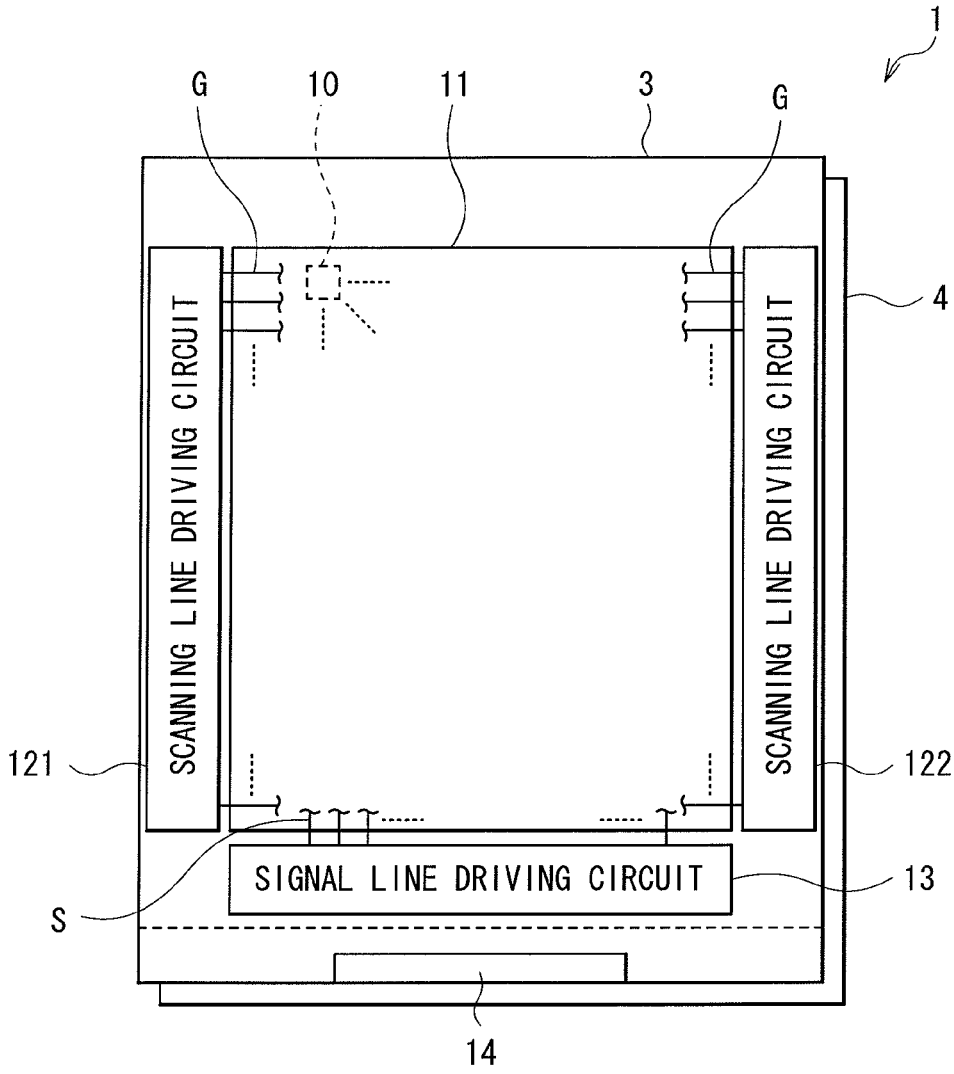
FIG. 1 is a block diagram illustrating an example of a schematic configuration of a display device according to an embodiment of the present disclosure.

FIG. 1 is a block diagram illustrating a schematic configuration of a display device (display device 1) according to an embodiment of the present disclosure. The display device 1 performs image display based on an image signal (not shown in the drawings) supplied from the outside. An example of the display device 1 described in this embodiment is a liquid crystal display device using a liquid crystal element (liquid crystal element LC) described later. The display device 1 includes a liquid crystal display panel 3 and a backlight 4.

The backlight 4 is a light source section which emits light to the liquid crystal display panel 3, and is configured of a light-emitting element such as CCFL (Cold Cathode Fluorescent Lamp) and LED (Light Emitting Diode).

The liquid crystal display panel 3 includes a plurality of pixels 10, scanning line driving circuits 121 and 122, a signal line driving circuit 13, and a connecting terminal 14 on a substrate formed of glass, for example. The plurality of pixels 10 are arranged in a display region (effective display region) 11, and the scanning line driving circuits 121 and 122, the signal line driving circuit 13, and the connecting terminal 14 are arranged in a frame region (non-display region) located at an outer edge (outer circumference) of the display region 11.

The connecting terminal 14 is for connecting wirings for various types of signals together to the outside of the display device.

The scanning line driving circuits 121 and 122, and the signal line driving circuit 13 (driving section) are for performing display driving to each pixel 10 based on a signal (image signal) input from the outside via the connecting terminal 14. The driving circuits perform display driving so that the gray-scale potential (black gray-scale potential or white gray-scale potential described later) of one type of potential line selected from plural types of potential lines (black-potential line LB and white-potential line LW described later in this embodiment) is supplied to a display element (liquid crystal element LC described later in this embodiment) in each pixel 10. This operation of the driving circuits will be described in detail later.

The scanning line driving circuits 121 and 122 sequentially select a plurality of pixels 10 for each horizontal line (row), using a plurality of scanning lines (gate lines) G extending along a direction of the horizontal line, thereby selecting pixels 10 to be driven in a line-sequential manner (line-sequential scanning).

The signal line driving circuit 13 supplies an image signal to a pixel 10 to be driven, using a plurality of signal lines (data lines) S extending along a direction of a vertical line (row). The signal lines S are each supplied with a one-bit image signal configured of binary digital data of a L (low) signal "0" and a H (high) signal "1".

The plurality of pixels 10 are arranged in the display region 11 in a matrix pattern.

[Detailed Configuration of Pixels 10]

Figure 2:
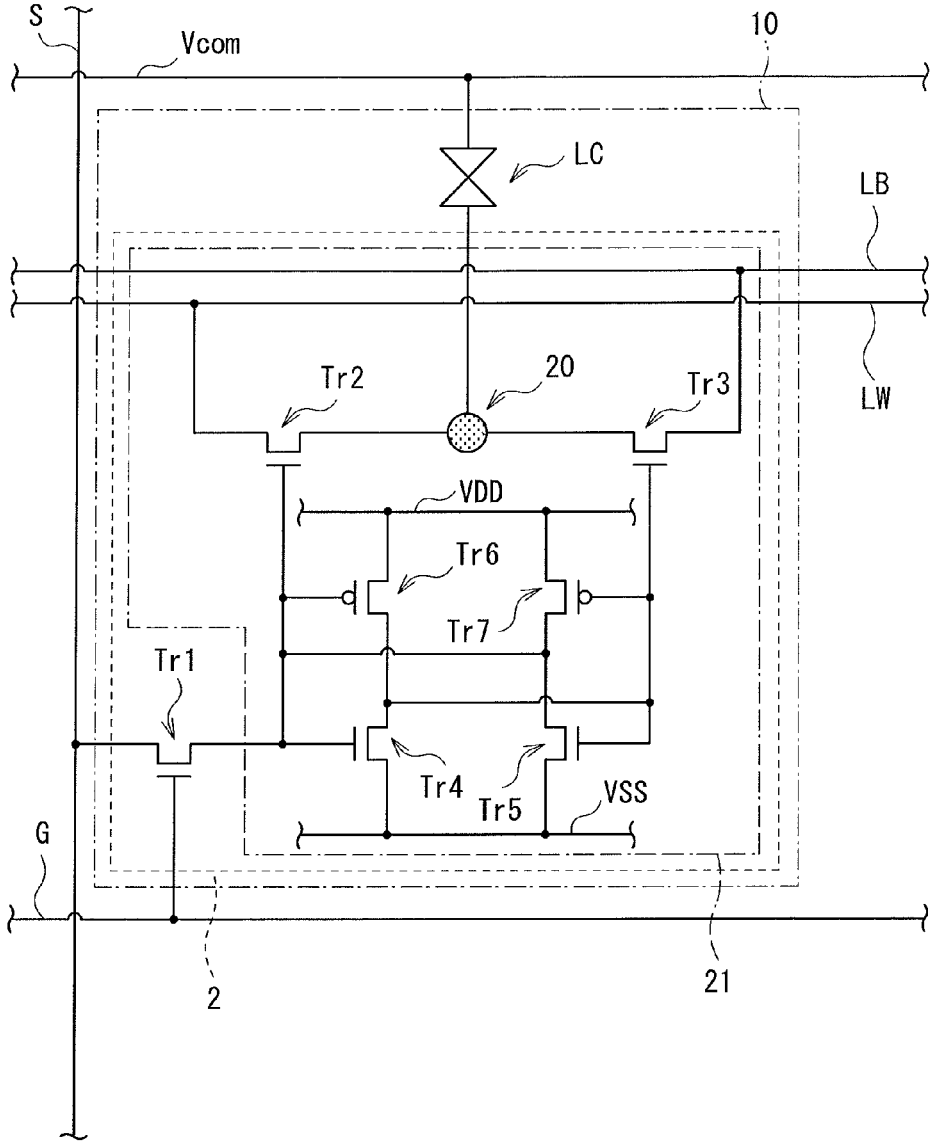
FIG. 2 is a circuit diagram schematically illustrating an example of a configuration of a pixel shown in FIG. 1.

FIG. 2 shows an example of a circuit configuration of each of the pixels 10. Each pixel 10 includes a liquid crystal element LC (display element) and a pixel circuit 2. The pixel circuit 2 has a TFT (Thin Film Transistor) element Tr1 and a storage circuit (memory circuit) 21. Further, the scanning line G, the signal line S, a common potential line (counter potential line) VCOM, the black-potential line LB (first potential line), and the white-potential line LW (second potential line) are connected to each pixel 10.

The black-potential line LB and the white-potential line LW are a plurality of (two in this embodiment) types of potential lines holding or maintained at different gray-scale potentials, and are formed to extend along the direction of the horizontal line. The black-potential line LB holds or maintained at a black gray-scale potential (approximately 3 V to 4 V, for example), and the white-potential line LW holds or maintained at a white gray-scale potential (approximately 0 V to 1 V, for example). In this embodiment, the resistance of the black-potential line LB is set lower than that of the white-potential line LW. Specifically, a wiring width of the black-potential line LB is larger than that of the white-potential line LW. A relation between the respective wirings of the black-potential line LB and the white-potential line LW will be described in detail later.

The liquid crystal element LC performs display operation in accordance with pixel driving by the pixel circuit 2. The liquid crystal element LC is configured of liquid crystal such as in a VA (Vertical Alignment) mode and a TN (Twisted Nematic) mode, for example. In this embodiment, the liquid crystal element LC is configured of a liquid crystal element in a normally white mode. The liquid crystal element LC is connected to the respective drains of the TFT element Tr2 and the TFT element Tr3 at one end of the liquid crystal element LC in adjacent to a pixel electrode 20 and is connected to the common potential line VCOM at the other end in adjacent to the counter electrode.

The pixel circuit 2 selects or selectively determines the gray-scale potential (black gray-scale potential or white gray-scale potential) of one of the black-potential line LB and the white-potential line LW based on the image signal supplied via the signal line S, and supplies the selected gray-scale potential to the liquid crystal element LC.

The TFT element Tr1 is a switching element for supplying, to the storage circuit 21, an image signal supplied from the signal line S, and an N-type transistor is used therefor in this embodiment. A gate of the TFT element Tr1 is connected to the scanning line G, and a source thereof is connected to the signal line S.

The storage circuit 21 is a circuit (latch circuit) storing or holding (temporarily holding) the image signal which has been input from the signal line S via the TFT element Tr1, and is configured of a SRAM (Static Random Access Memory) circuit having six TFT elements denoted by Tr2 to Tr7 in this embodiment. Of the TFT elements Tr2 to Tr7, four TFT elements or TFT elements Tr2, Tr3, Tr4, and Tr5 are N-type transistors, and the other two TFT elements or TFT elements Tr6 and Tr7 are P-type transistors. A gate of the TFT element Tr2 is connected to a drain of the TFT element Tr1, a gate of the TFT element Tr4, a gate of the TFT element Tr6, a drain of the TFT element Tr5, and a drain of the TFT element Tr7. A source of the TFT element Tr2 is connected to the white-potential line LW, and a drain thereof is connected to the pixel electrode 20. A gate of the TFT element Tr3 is connected to a gate of the TFT element Tr5, a gate of the TFT element Tr7, a drain of the TFT element Tr4, and a drain of the TFT element Tr6. A source of the TFT element Tr3 is connected to the black-potential line LB, and a drain thereof is connected to the pixel electrode 20. Respective sources of the TFT element Tr4 and TFT element Tr5 are connected to a ground potential VSS, and respective sources of the TFT element Tr6 and TFT element Tr7 are connected to a power source potential VDD.

[Operations and Advantages of Display Device 1]

Display Operation)

In the display device 1, the scanning line driving circuits 121 and 122, and the signal line driving circuit 13 perform the display driving operation in synchronization with one another based on the input signal supplied from the outside via the connecting terminal 14. Specifically, each of the scanning line driving circuits 121 and 122 sequentially selects the pixel 10 for each horizontal line, using the scanning line G, to perform the line sequential scanning. Further, the signal line driving circuit 13 supplies the image signal to the pixel 10 to be driven via the signal line S. In the pixel 10 to which the image signal has been supplied, illumination light from the backlight 4 is modulated to be emitted as display light. In this way, image display based on the input signal is performed in the display device 1.

The display operation in each pixel 10 will now be described in detail with reference to FIGS. 3 and 4. It is to be noted that the liquid crystal element LC here is a liquid crystal element in a normally white mode, as mentioned above. It is also to be noted that each of the TFT elements Tr1 to Tr7 is shown as a switch in FIGS. 3 and 4 for convenience of description. Therefore, the TFT element Tr1 is in an ON state in the drawings in the pixel 10 to be driven.

Figure 3:
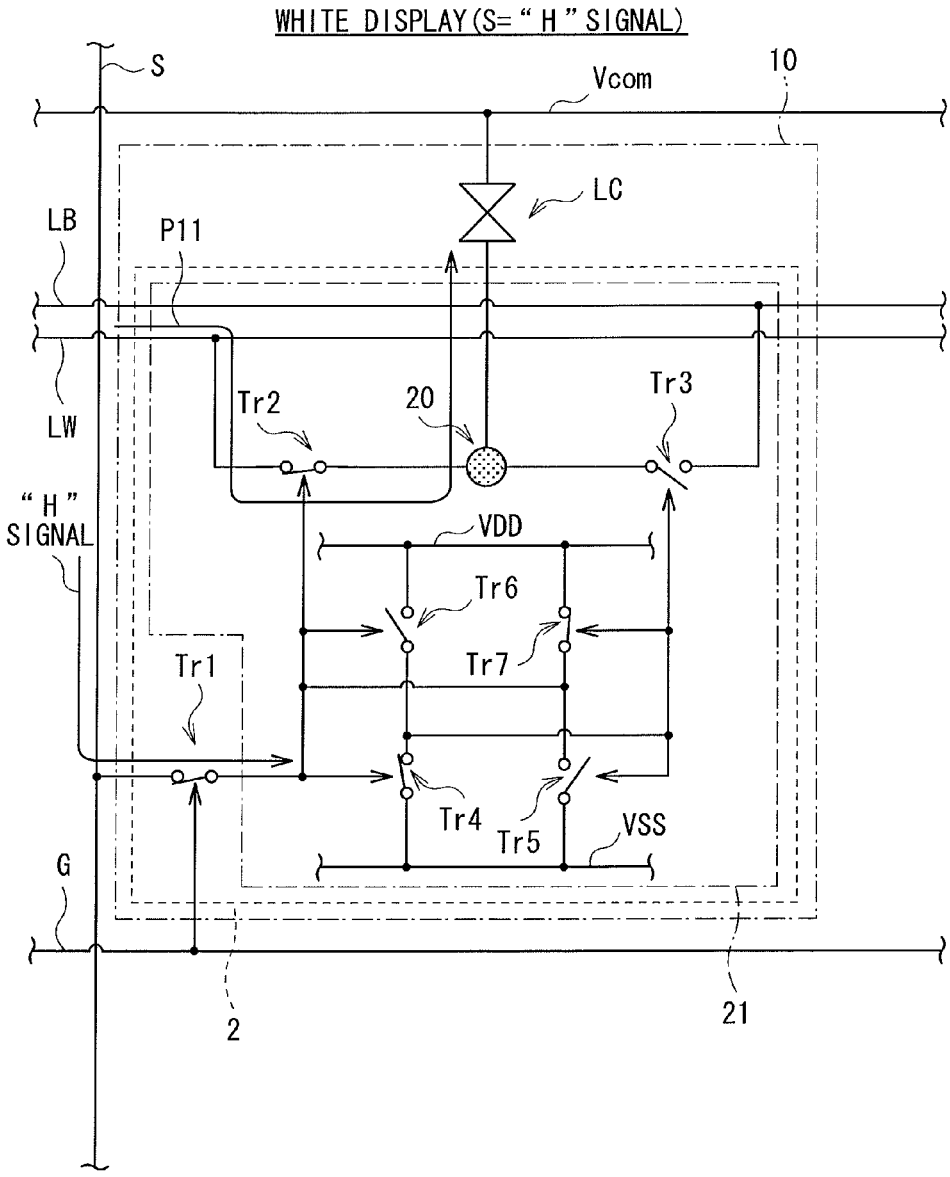
FIG. 3 is a circuit diagram illustrating a general outline of an operation of the pixel shown in FIG. 2 at white display.

First, as shown in FIG. 3, when the "H" signal is supplied from the signal line S to the pixel 10 to be driven, white display is performed in the pixel 10 in the following manner. That is, since a "H" signal is supplied to the storage circuit 21 to be latched (temporarily held) via the TFT element Tr1, the TFT elements Tr2, Tr4, and Tr7 are in an ON state and the TFT elements Tr3, Tr5, and Tr6 are in an OFF state. Hence, the potential (white gray-scale potential) of the white-potential line LW is supplied to the pixel electrode 20 of the liquid crystal element LC, as indicated by the arrow P11 in FIG. 3, so that white display is performed in the liquid crystal element LC.

Figure 4:
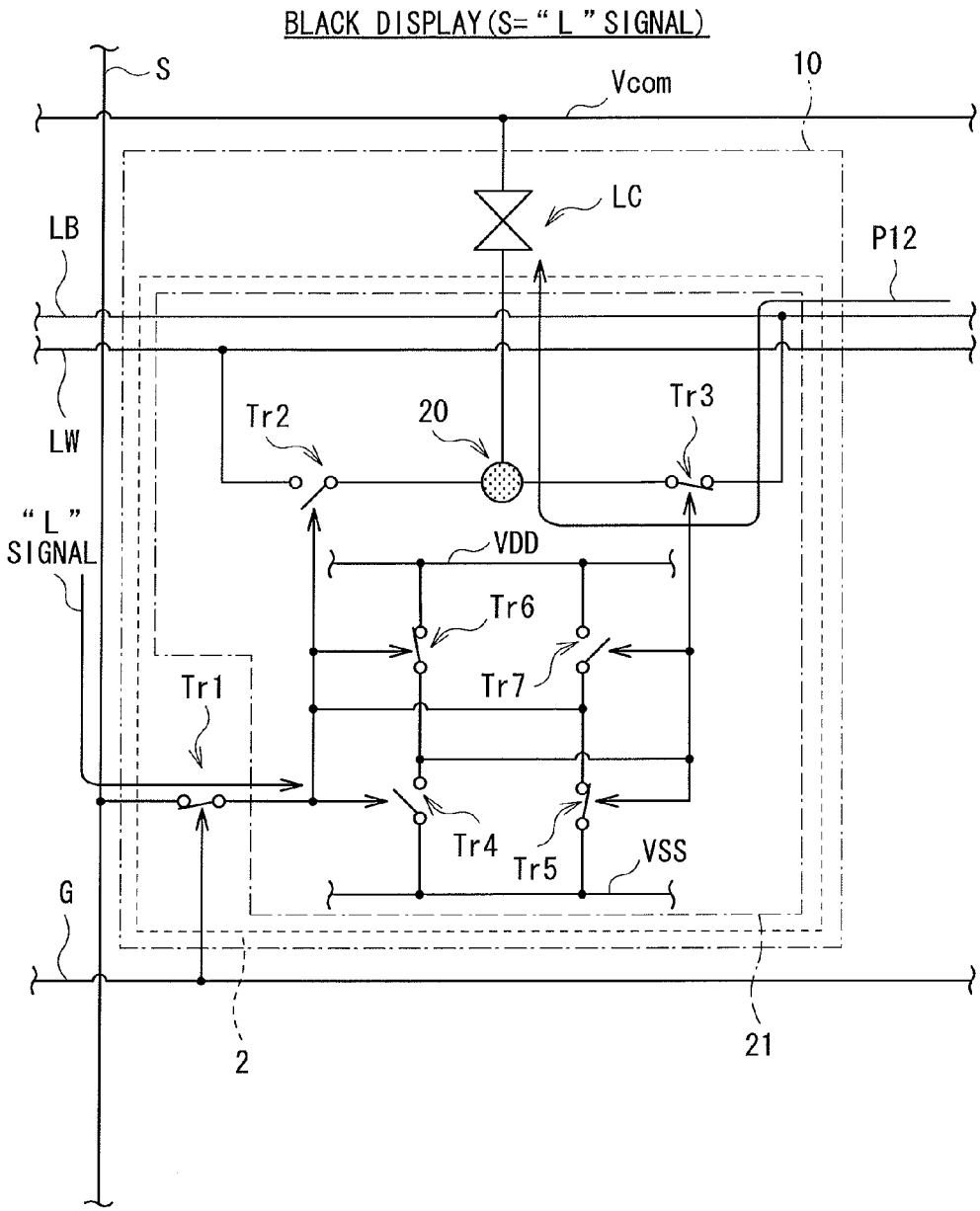
FIG. 4 is a circuit diagram illustrating a general outline of an operation of the pixel shown in FIG. 2 at black display.

On the other hand, as shown in FIG. 4, when the "L" signal is supplied from the signal line S to the pixel 10 to be driven, black display is performed in the pixel 10 in the following manner. That is, since the "L" signal is supplied to the storage circuit 21 to be latched via the TFT element Tr1, the TFT elements Tr2, Tr4, and Tr7 are in an OFF state and the TFT elements Tr3, Tr5, and Tr6 are in an ON state, contrary to the case of white display. Hence, the potential (black gray-scale potential) of the black-potential line LB is supplied to the pixel electrode 20 of the liquid crystal element LC, as indicated by the arrow P12 in FIG. 4, so that black display is performed in the liquid crystal element LC.

In this way, in each pixel 10, the gray-scale potential (black gray-scale potential or white gray-scale potential) of one of the black-potential line LB and the white-potential line LW is selectively supplied to the liquid crystal element LC based on the image signal supplied via the signal line S, so that black display or white display is performed (two-color display). In a case where the plurality of pixels 10 in the display region 11 are configured of pixels of three primary colors, such as red (R) pixels, green (G) pixels, and blue (B) pixels, using, for example, color filters, eight-color (2×2×2) display is performed as a whole if the two-color display is performed in the pixels of each color.

(2. Operations)

Next, the operations of the liquid crystal display panel 3 will be described in detail with reference to FIGS. 5 to 8.

First, in the liquid crystal display panel 3, short circuit between electrodes may occur due to such as foreign substances mixed by a process defect in manufacturing, for example. Specifically, in an example shown in FIG. 5, short circuit of the pixel electrodes 20 has occurred due to such as foreign substances between two pixels 10-1 and 10-2 which are adjacent to each other along the direction of the vertical line (see the arrow P21 in FIG. 5). Further, in an example shown in FIG. 6, short circuit has occurred due to such as foreign substances between the respective regions of the liquid crystal element LC which are adjacent to the pixel electrode 20 and the counter electrode (common potential line VCOM) (see the arrow P22 in FIG. 6). Illustration of the liquid crystal element LC is omitted in FIG. 5 for easy description.

Figure 5:
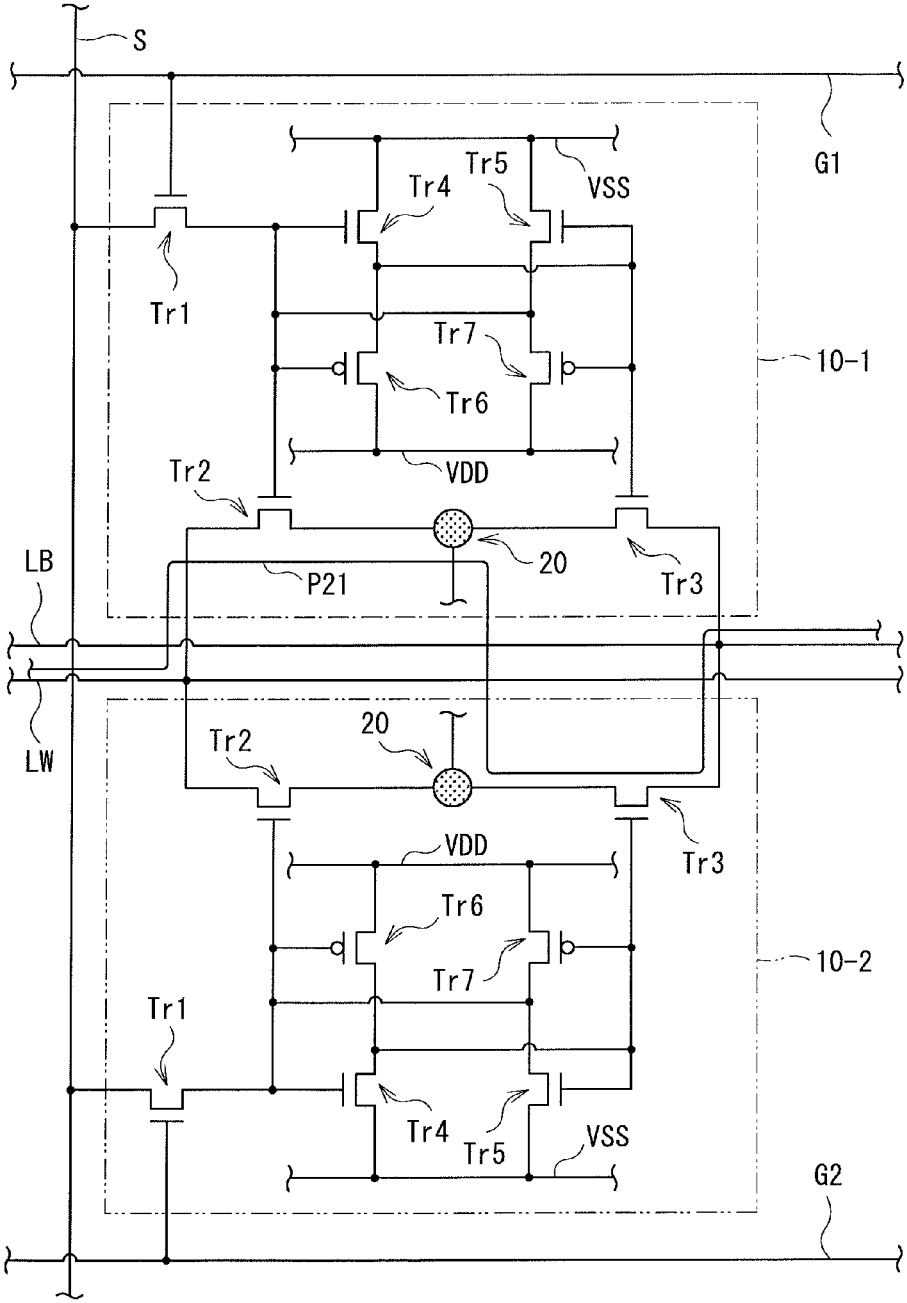
FIG. 5 is a circuit diagram for describing short circuit between pixel electrodes in the adjacent pixels.
Figure 6:
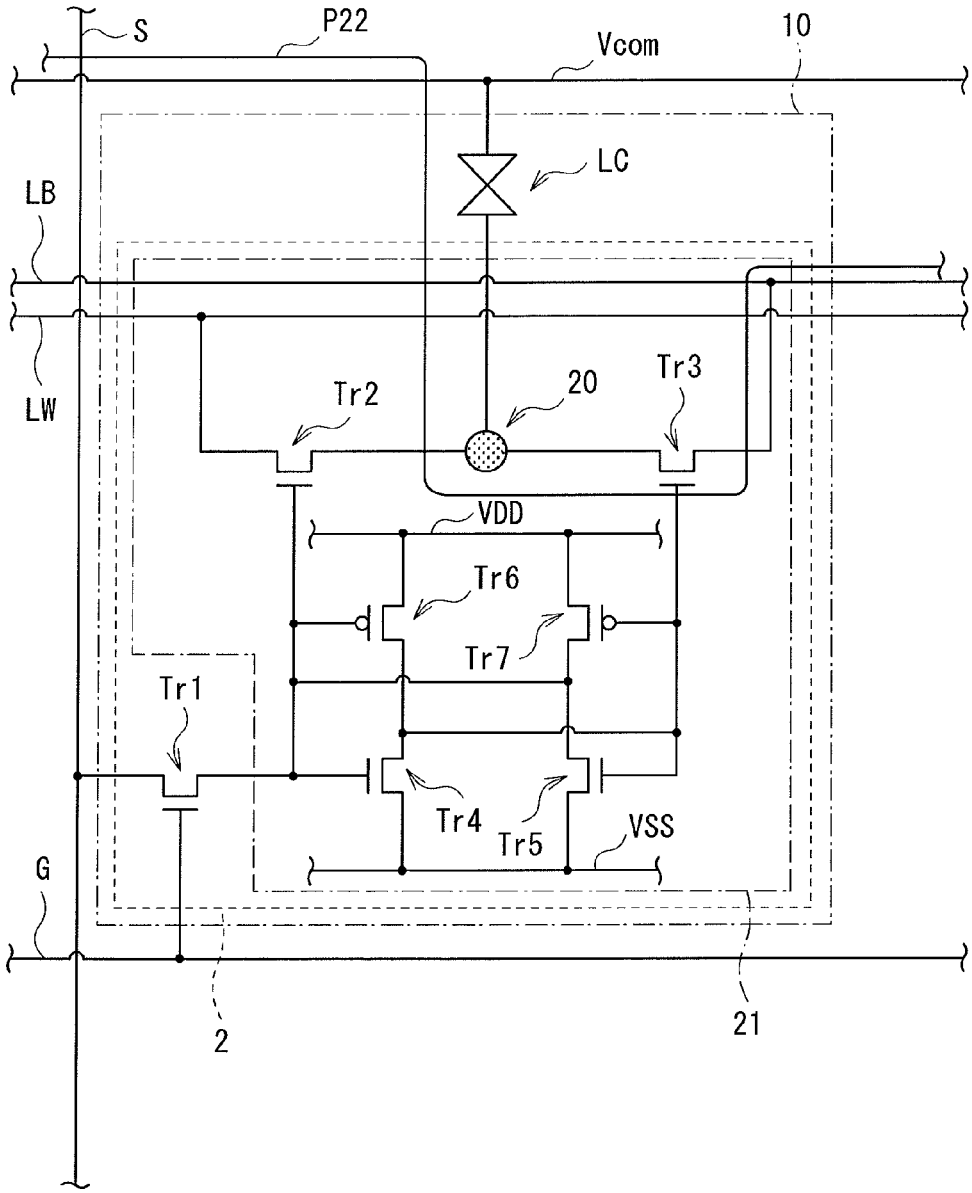
FIG. 6 is a circuit diagram for describing short circuit between the pixel electrode and a counter electrode in the pixel.

When the short circuit between electrodes has occurred, the potentials (black gray-scale potential and white gray-scale potential) of the black-potential line LB and the white-potential line LW vary, as can be seen from the arrows P21 in FIG. 5 and P22 in FIG. 6. The display luminance varies accordingly as described later, resulting in low yield in manufacturing.

Figure 7:
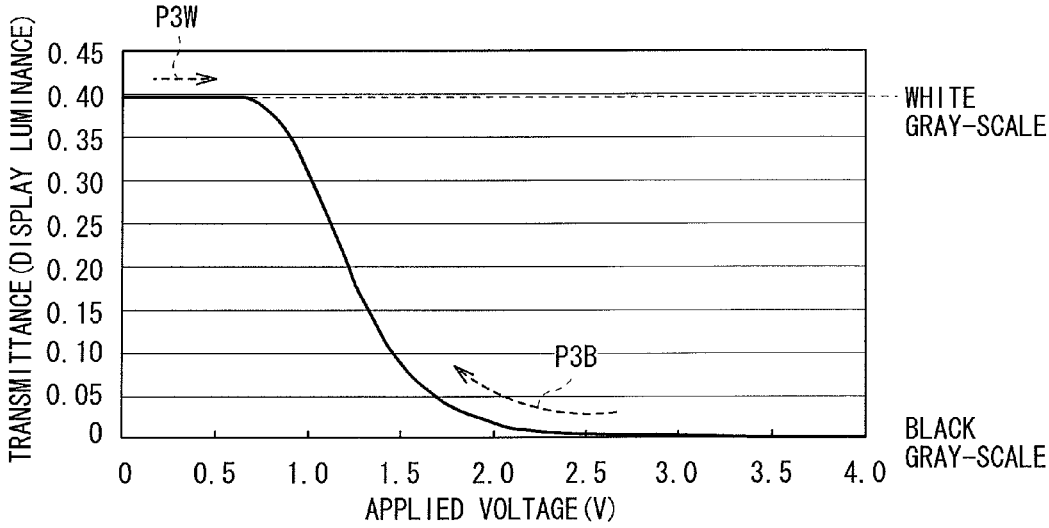
FIG. 7 is a characteristic diagram illustrating an example of a relation between an applied voltage and a light transmission with regard to a liquid crystal element.

FIG. 7 shows an example of a relation (display characteristic) between an applied voltage and a light transmittance (display luminance) with regard to the liquid crystal element LC. In an example shown in FIG. 7, when the applied voltage ranges from approximately 0 V to 0.7 V, the transmittance is virtually constant (approximately 0.4 V, corresponding to the white gray-scale). When the applied voltage ranges from approximately 2.5 V to 4.0 V, the transmittance is virtually constant (approximately 0 V, corresponding to the black gray-scale). In a voltage range between the above two voltage ranges, that is, in a voltage range from approximately 0.7 V to 2.5 V, the transmittance rapidly changes between the white gray-scale and the black gray-scale. That is, in this voltage range (the voltage range corresponding to the halftone), the luminance gradient (luminance inclination) corresponding to or representing the variation (amount or magnitude of variation) in the transmittance caused by the variation (amount or magnitude of variation) in the applied voltage is steep.

Hence, variation in the black gray-scale potential or the white gray-scale potential (variation from the original applied voltage) due to the short circuit between electrodes causes variation in the transmittance (display luminance) in the liquid crystal element LC, as indicated by the arrows P3B and P3W in FIG. 7. In particular, as can be seen from the arrows P3B and P3W, the variation in the display luminance resulting from the variation in the white gray-scale potential is relatively larger than the variation in the display luminance resulting from the variation in the black gray-scale potential. This is because the luminance gradient around the black gray-scale potential is relatively steeper than the luminance gradient around the white gray-scale potential. The luminance variation generated due to the short circuit between the electrodes in the pixel 10 results in not only the point defects in the pixel 10 itself but also line defects in the plurality of pixels 10 for one horizontal line along the black-potential line LB and the white-potential line LW, for example, thereby reducing the yield in manufacturing. With the development of size and resolution of display devices, such a disadvantage can be particularly notable in a display device that includes a pixel circuit.

In the present embodiment, the potential line (black-potential line LB), maintained at the gray-scale potential (black gray-scale potential) allowing the luminance gradient to be relatively steep, has a lower resistance than the potential line (white-potential line LW), maintained at the gray-scale potential (white gray-scale potential) allowing the luminance gradient to be relatively gentle. In other words, RB is smaller than RW (RB<RW), where the resistance of the black-potential line LB is RB and the resistance of the white-potential line LW is RW. A difference in the resistance is preferably as large as possible and that RB to RW (RB:RW) is approximately between 1.0 to 1.5 (1.0:1.5) and 1.0 to 10.0 (1.0:10.0) both inclusive, for example.

Figure 8:
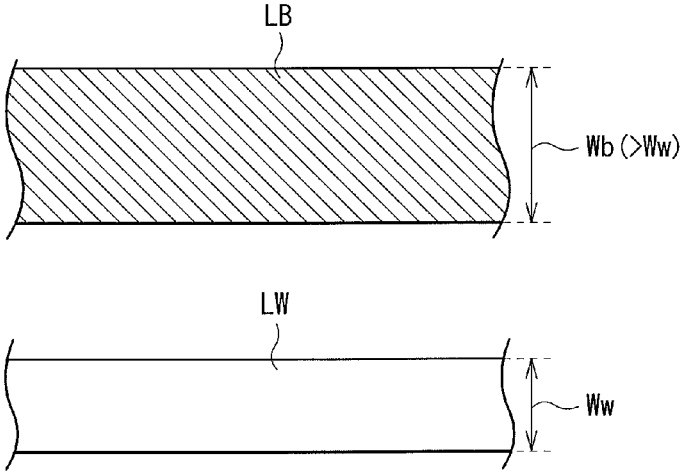
FIG. 8 is a schematic plan view illustrating examples of configurations of a black-potential line and a white-potential line according to the embodiment of the present disclosure.

Specifically, in the present embodiment, since the wiring width Wb of the black-potential line LB is larger than the wiring width Ww of the white-potential line LW (Wb>Ww), RB is smaller than RW (RB<RW), as shown in FIG. 8. A difference in the wiring width is preferably as large as possible and that Wb to Ww (Wb:Ww) is approximately between 1.5 to 1.0 (1.5:1.0) and 10.0 to 1.0 (10.0:1.0) both inclusive, for example (Wb:Ww=1.5:1.0, for example).

Thus, even when the short circuit between the electrodes resulting from such as the foreign substances has varied the potential (black gray-scale potential that allows the luminance gradient to be relatively steep) of the black-potential line LB, it is possible to suppress the variation in display luminance in the liquid crystal element LC to which the varied black gray-scale potential is supplied.

Thus, in the present embodiment, the resistance RB of the black-potential line LB, maintained at the black gray-scale potential that allows the luminance gradient to be relatively steep, is lower than the resistance RW of the white-potential line LW, maintained at the white gray-scale potential that allows the luminance gradient to be relatively gentle. Hence, even when the black gray-scale potential has varied, it is possible to suppress the variation in the display luminance of the liquid crystal element LC to which the varied black gray-scale potential is supplied. This makes it possible to avoid such as the occurrence of the line defects (defects of the plurality of pixels 10 along the black-potential line LB) and generate only the point defects, for example, improving the yield in manufacturing and display quality.

Further, since setting the wiring width Wb of the black-potential line LB to be larger than the wiring width Ww of the white-potential line LW (Wb>Ww) leads to establishing the relation in which RB is smaller than RW (RB<RW), a mask pattern to be used for forming the potential lines may be altered without altering such as a material of the black-potential line LB or the white-potential line LW, making it easier to achieve those potential lines.

Furthermore, allowing a total width (Wb+Ww) of the black-potential line LB and the white-potential line LW to be equal to that in an existing example whose wiring widths are uniform (Wb=Ww) makes it possible to achieve the above advantages without reducing the resolution of the pixels 10 in the display region 11 (while maintaining the resolution).

MODIFICATION EXAMPLES

Modification examples 1 and 2 of the embodiment described above will now be described. It is to be noted that like components are denoted with like reference numerals as of the embodiment described above, and are not further described.

First Modification

Figure 9:
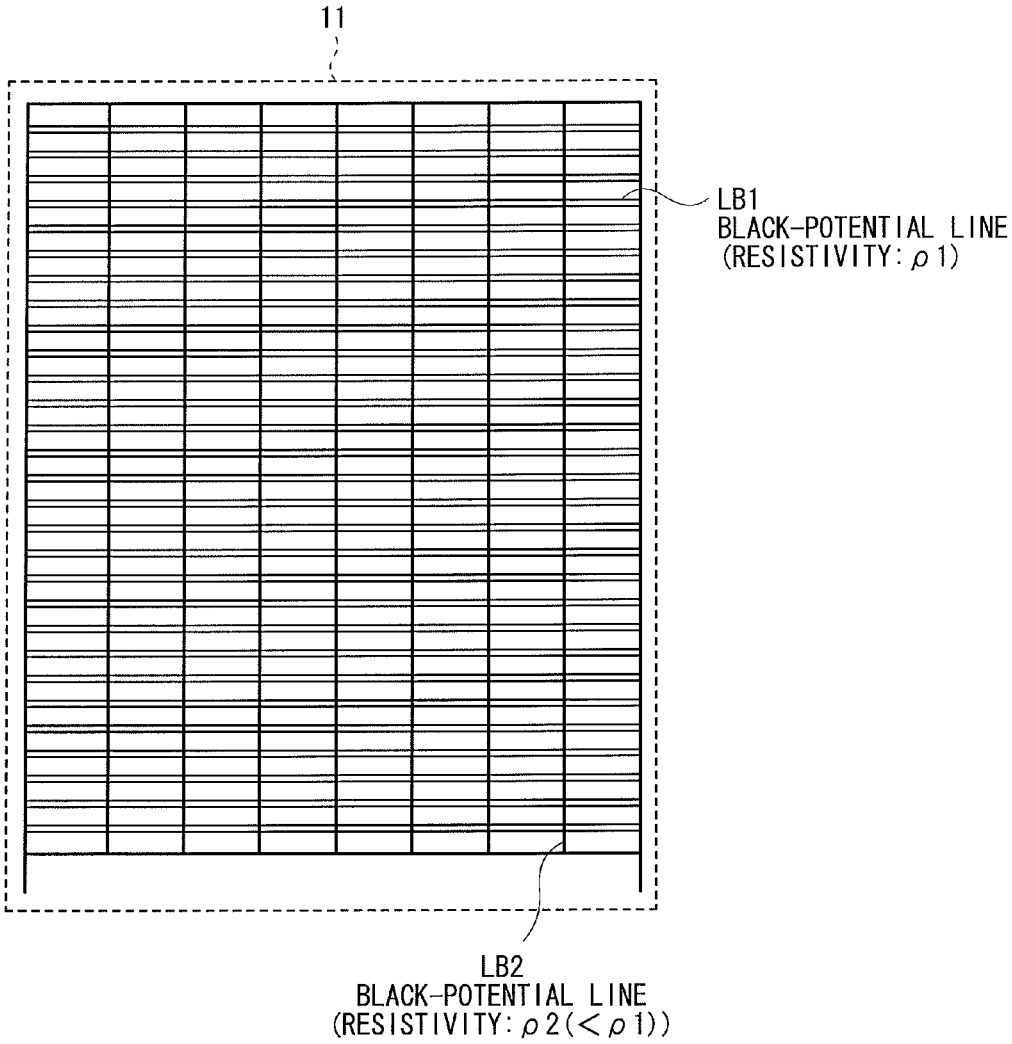
FIG. 9 is a schematic plan view illustrating an example of a configuration of the black-potential line according to a first modification.

FIG. 9 schematically illustrates an example of a plane configuration of black-potential lines (LB1 and LB2) according to a first modification. In the display device 1 of the first modification, the resistance RB of the black-potential line LB maintained at the black gray-scale potential in which the luminance gradient is relatively steep is lower than the resistance RW of the white-potential line LW maintained at the white gray-scale potential in which the luminance gradient is relatively gentle (RB<RW), as in the embodiment described above.

However, unlike the above embodiment, the resistivity of one part or more of the wiring of the black-potential line is lower than the resistivity of the white-potential line LW in the first modification. Thus, the resistance RB is smaller than the resistance RW (RB<RW). Specifically, in the first modification, the black-potential line is configured of two wirings (black-potential lines LB1 and LB2) which are formed of different materials (with different resistivities) and are formed in different layers.

In detail, the black-potential line LB1 (for example, a higher-resistivity wiring) is formed in the same layer as that of the white-potential line LW (not shown in FIG. 9) and is formed of the same material (for example, molybdenum) as that of the white-potential line LW. Two or more black-potential lines LB1 are provided so as to each extend along the direction of the horizontal line, as with the black-potential line LB in the embodiment.

On the other hand, the black-potential line LB2 (for example, a lower-resistivity wiring) is formed in a layer different from that of the white-potential line LW so as to be electrically connected to the black-potential lines LB1 via a contact not shown in the drawings, and is configured of a material (for example, aluminum) having a lower resistivity than that of the material of the white-potential line LW. In other words, ρ2 is smaller than ρ1 (ρ2<ρ1), where the resistivity of the black-potential lines LB1 and white-potential line LW is ρ1 and the resistivity of the black-potential line LB2 is ρ2. A difference in the resistivity is preferably as large as possible and ρ1 to ρ2 is between approximately 10 to 1 and 100 to 1 (ρ1: ρ2=about 10:1 to 100:1) both inclusive, for example.

Two or more black-potential lines LB2 are provided so as to each extend along the direction of the vertical line, unlike the black-potential lines LB1 and the white-potential line LW. In the first modification, the plurality of black-potential lines LB2 are thinned out for the plurality of pixels 10 in the display region 11. In other words, one black-potential line LB2 is arranged for two or more pixels 10 along the direction of the horizontal line.

Thus, in the first modification, setting the resistivity of at least a part of the wirings of the black-potential lines to be lower than that of the white-potential line LW leads to establishing the relation in which RB is smaller than RW (RB<RW). Hence, it is possible to achieve advantages similar to those of the above embodiment by operations similar to those of the embodiment.

Further, since the plurality of black-potential lines LB2 are thinned out for the plurality of pixels 10 in the display region 11, it is possible to suppress the occurrence of short circuit etc. between wirings of the black-potential lines LB2 each formed of a low resistivity material, for example.

Although the first modification is an example in which the two black-potential lines LB1 and LB2 formed of different wiring materials (with different resistivities) are formed in different layers, the black-potential lines LB1 and LB 2 may be formed in the same layer in some cases. However, since it is generally difficult to form two or more wiring layers formed of different materials in the same layer, or forming such wiring layers in the same layer complicates a manufacturing process, the configuration of the first modification may be preferable.

Second Modification (Circuit Configuration of Pixels 20A)

Figure 10:
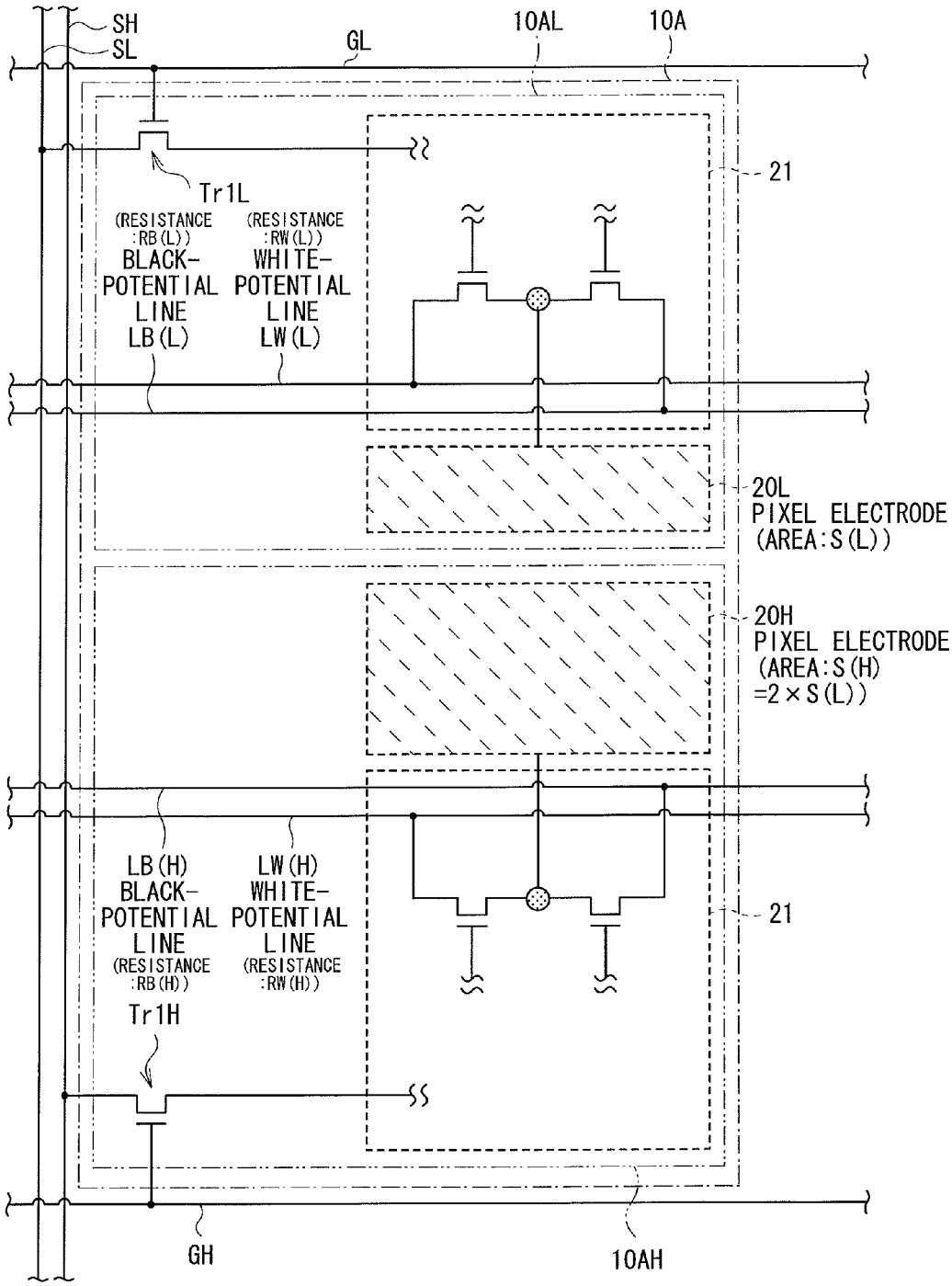
FIG. 10 is a circuit diagram schematically illustrating an example of a configuration of the pixel according to a second modification.

FIG. 10 schematically illustrates an example of a circuit configuration of pixels (pixels 10A) according to a second modification. The display device 1 of the second modification performs multi-gray-scale display in each of the pixels 10A, using an image signal configured of a plurality of bits (plural bits). In this modification, a description will be made of an example where the image signal is configured of a two-bit signal (each bit is binary data of "L" or "H"). That is, four-gray-scale display, which is multiplication of two bits by two gray-scales (black and white gray-scales), is performed in each pixel 10A, as described later. In FIG. 10, the liquid crystal element LC and the common potential line VCOM are omitted for easy illustration.

Each of the pixels 10A in the second modification has a sub-pixel 10AL used for gray-scale display of the lower (first bit) one of the bits (lower-order bit) and a sub-pixel 10AH used for gray-scale display of the higher (second bit) one of the bits (higher-order bit), thus establishing a multiple sub-pixel structure. The sub-pixel 10AL has a TFT element Tr1L, the liquid crystal element LC containing a pixel electrode 20L, and the storage circuit 21. Likewise, the sub-pixel 10AH includes a TFT element Tr1H, the liquid crystal element LC containing a pixel electrode 20H, and the storage circuit 21. Each of the sub-pixels 10AL and 10AH has a display region with the area (corresponding to the area of the pixel electrode) corresponding to a significance (weighting) of corresponding bit of the image signal. In other words, the area S(H) of the pixel electrode 20H in the sub-pixel 10AH of the higher-order bit is twice the area S(L) of the pixel electrode 20L in the sub-pixel 10AL of the lower-order bit (S(H)=2×S(L)).

Further, each of the pixels 10A is separately connected to the scanning line G, the signal line S, the black-potential line LB, and the white-potential line LW on a bit-by-bit basis of the image signal. Specifically, the sub-pixel 10AL of the lower-order bit is connected to a scanning line GL, a signal line SL, a black-potential line LB(L), and a white-potential line LW(L). Further, the sub-pixel 10AH of the higher-order bit is connected to a scanning line GH, a signal line SH, a black-potential line LB(H), and a white-potential line LW(H). Since a manner of connection of each wiring in the sub-pixels 10AL and 10AH is similar to that in the pixel 10 in the above embodiment, the description thereof is omitted.

(Display Operation of Pixel 10A)

In the thus-configured pixel 10A, display operation is performed as shown in FIG. 11 if the liquid crystal element LC is one in a normally white mode as in the embodiment. When the "L" signal is supplied from each of the signal lines SH and SL to the pixel 10 to be driven, black display is performed in the sub-pixel 10AH (pixel electrode 20H) and the sub-pixel 10AL (pixel electrode 20L). Therefore, black gray-scale display with the lowest display luminance (display at zero gray level) is performed in this case.

When the "L" signal and the "H" signal are supplied from the signal lines SH and SL, respectively, to the pixel 10 to be driven, black display is performed in the sub-pixel 10AH (pixel electrode 20H) and white display is performed in the sub-pixel 10AL (pixel electrode 20L). Therefore, in consideration of the significance of the areas S(H) and S(L) of the pixel electrodes 20H and 20L in the sub-pixels 10AH and 10AL, respectively, halftone (gray) display with the second lowest display luminance (display at first gray level) is performed in this case.

When the "H" signal and the "L" signal are supplied from the signal lines SH and SL, respectively, to the pixel 10 to be driven, white display is performed in the sub-pixel 10AH (pixel electrode 20H) and black display is performed in the sub-pixel 10AL (pixel electrode 20L). Therefore, in consideration of the significance of the areas S(H) and S(L) of the pixel electrodes 20H and 20L in the sub-pixels 10AH and 10AL, respectively, halftone (gray) display with the second highest display luminance (display at second gray level) is performed in this case.

When the "H" signal is supplied from each of the signal lines SH and SL to the pixel 10 to be driven, white display is performed in each of the sub-pixel 10AH (pixel electrode 20H) and the sub-pixel 10AL (pixel electrode 20L). Therefore, white gray-scale display with the highest display luminance (display at third gray level) is performed in this case.

In this way, in the second modification, the multi-gray-scale display is performed in each of the pixels 10A using the image signal configured of a plurality of bits.

(Configuration and Operation)

In this modification, as in the embodiment, the resistance of the black-potential line maintained at the black gray-scale potential that allows the luminance gradient to be relatively steep is lower than the resistance of the white-potential line maintained at the white gray-scale potential that allows the luminance gradient to be relatively gentle. Specifically, in the sub-pixel 10AL of the lower-order bit, the resistance RB(L) of the black-potential line LB(L) is lower than the resistance RW(L) of the white-potential line LW(L) (RB(L)<RW(L)). Likewise, in the sub-pixel 10AH of the higher-order bit, the resistance RB(H) of the black-potential line LB(H) is lower than the resistance RW(H) of the white-potential line LW(H) (RB(H)<RW(H)). For example, if the resistance is varied by the difference in the wiring width as in the embodiment, the wiring width Wb(L) of the black-potential line LB(L) is larger than the wiring width Ww(L) of the white-potential line LW(L) in the sub-pixel 10AL of the lower-order bit (Wb(L)>Ww(L)). Likewise, in the sub-pixel 10AH of the higher-order bit, the wiring width Wb(H) of the black-potential line LB(H) is larger than the wiring width Ww(H) of the white-potential line LW(H) (Wb(H)>Ww(H)).

Further, in this modification, the resistance RB(H) of the black-potential line LB(H) of the higher-order bit is not higher than the resistance RB(L) of the black-potential line LB(L) of the lower-order bit (RB(H)≤RB(L)). Likewise, the resistance RW(H) of the white-potential line LW(H) of the higher-order bit is not higher than the resistance RW(L) of the white-potential line LW(L) of the lower-order bit (RW(H)≤RW(L)). For example, if the resistance is varied by the difference in the wiring width as in Embodiment, the wiring width Wb(H) of the black-potential line LB(H) of the higher-order bit is not smaller than the wiring width Wb(L) of the black-potential line LB(L) of the lower-order bit (Wb(H)≥Wb(L)). Likewise, the wiring width Ww(H) of the white-potential line LW(H) of the higher-order bit is not smaller than the wiring width Ww(L) of the white-potential line LW(L) of the lower-order bit (Ww(H)≥Ww(L)).

To summarize these, in this modification, the conditional expressions shown in FIG. 12A to FIG. 12C are satisfied for the resistances RB(L), RB(H), the wiring widths Wb(L), and Wb(H) of the black-potential lines LB(L) and LB(H), as well as the resistances RW(L), RW(H), the wiring widths Ww(L), and Ww(H) of the white-potential lines LW(L) and LW(H), for example.

Specifically, in an example shown in FIG. 12A, the following Expression 1 (the following Expression 2 as an example) is satisfied.

$$RB(H)<RB(L)<RW(H)<RW(L) \quad \text{Expression 1}$$

$$Wb(H)>Wb(L)>Ww(H)>Ww(L) \quad \text{Expression 2}$$

Further, in an example shown in FIG. 12B, the following Expression 3 (the following Expression 4 as an example) is satisfied.

$$RB(H)<RB(L)<RW(H)=RW(L) \quad \text{Expression 3}$$

$$Wb(H)>Wb(L)>Ww(H)=Ww(L) \quad \text{Expression 4}$$

Furthermore, in an example shown in FIG. 12C, the following Expression 5 (the following Expression 6 as an example) is satisfied.

$$RB(H)=RB(L)<RW(H)=RW(L) \quad \text{Expression 5}$$

$$Wb(H)=Wb(L)>Ww(H)=Ww(L) \quad \text{Expression 6}$$

Since the relations of RB(H)≤RB(L) and RW(H)≤RW(L) are satisfied in this modification, it is possible to achieve especially the following advantages, in addition to the advantages achieved in the embodiment, when the multi-gray-scale display is performed using the image signal configured of a plurality of bits. Specifically, in consideration of the significance of the area of the display region (pixel electrode), the luminance variation at the gray-scale display in the sub-pixel 10AH of the higher-order bit is more noticeable than that at the gray-scale display in the sub-pixel 10AL of the lower-order bit (effect of decrease in the quality of displayed images is more large). Therefore, setting the resistance of the potential line of the lower-order bit to be not higher than (preferably, lower than) the resistance of the potential line of the higher-order bit makes it possible to preferentially suppress the luminance variation of the higher-order bit, allowing further improvement in the display quality.

Although the resistances of the potential lines are varied by the difference in the wiring width in the second modification as in the embodiment, it is not limited thereto. The resistances of the potential lines may be varied by the difference in the resistivity (material of the wiring), as in the first modification.

Further, although the image signal is configured of a two-bit signal in the second modification, it is not limited thereto. The image signal may be configured of a signal of three bits or more.

APPLICATION EXAMPLES

Application examples of the display device 1 described in the embodiment and the modifications described above will now be described with reference to FIGS. 13 to 17G. The display devices 1 according to the embodiment and the modifications are applicable to electronic units in any field, such as, but not limited to, television units, digital cameras, mobile terminal units such as notebook computers and mobile phones, and video cameras. In other words, the display devices 1 are applicable to electronic units in any field which display, as images or pictures, image signals input from the outside or image signals generated therein.

Application Example 1

FIG. 13 illustrates an external appearance of a television unit to which the display device 1 according to any one of the embodiment and the modifications is applied. The television device has, for example, an image display screen section 300 including a front panel 310 and a filter glass 320. The image display screen section 300 is configured of the display device 1 according to any one of the embodiment and the modifications.

Application Example 2

FIGS. 14A and 14B each illustrate an external appearance of a digital camera to which the display device 1 according to any one of the embodiment and the modifications is applied. The digital camera has, for example, an emitting section 410 for flash, a display section 420, a menu switch 430, and a shutter bottom 440. The display section 420 is configured of the display device 1 according to any one of the embodiment and the modifications.

Application Example 3

Figure 15:
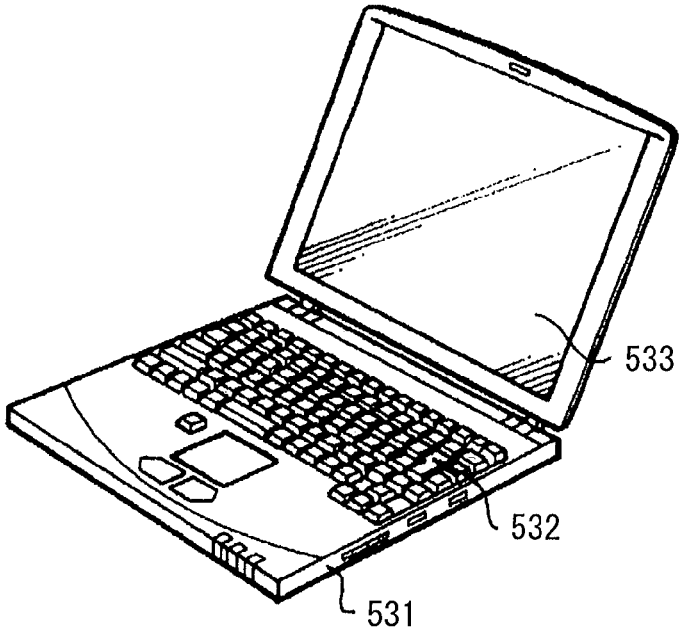
FIG. 15 is a perspective view illustrating an external appearance of a third application example.

FIG. 15 illustrates an external appearance of a notebook computer to which the display device 1 according to any one of the embodiment and the modifications is applied. The notebook computer has, for example, a body 510, a keyboard 520 for input operation of characters etc., and a display section 530 which displays an image. The display section 530 is configured of the display device 1 according to any one of the embodiment and the modifications.

Application Example 4

Figure 16:
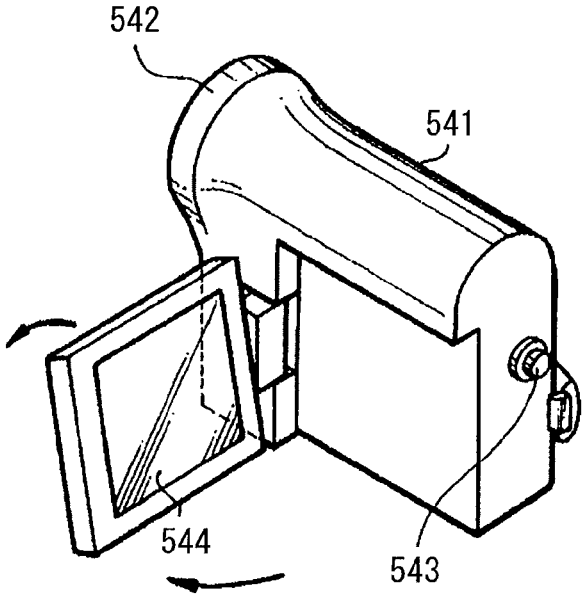
FIG. 16 is a perspective view illustrating an external appearance of a fourth application example.

FIG. 16 illustrates an external appearance of a video camera to which the display device 1 according to any one of the embodiment and the modifications is applied. The video camera has, for example, a body section 610, a lens 620 provided on the front side of the body section 610 for taking an image of an object, and a start/stop switch 630 at the image taking, and a display section 640. The display section 640 is configured of the display device 1 according to any one of the embodiment and the modifications.

Application Example 5

FIGS. 17A to 17G each illustrate an external appearance of a mobile phone to which the display device 1 according to any one of the embodiment and the modifications is applied. The mobile phone has, for example, an upper housing 710, a lower housing 720, a connecting section (hinge section) 730 which connects the upper and lower housings 710 and 720 to each other, a display 740, a sub-display 750, a picture light 760, and a camera 770. The display 740 or the sub-display 750 is configured of the display device 1 according to any one of the embodiment and the modifications.

OTHER MODIFICATIONS

Although the present technology has been described with reference to the embodiment, the modifications, and the application examples, it is not limited thereto and various variations may be made.

Specifically, although each of the embodiment, the modifications, and the application examples, for example, is a case where the liquid crystal element LC is configured of a liquid crystal element in a normally white mode, it is not limited thereto. The liquid crystal element LC may be configured of a liquid crystal element in a normally black mode. When the liquid crystal element in a normally black mode is used, the relation of the black-potential line LB and the white-potential line LW in terms of the luminance gradient described above is the opposite (the luminance gradient of the white gray-scale potential is relatively steeper than that of the black gray-scale potential). In this case, the resistance RW of the white-potential line LW (first potential line) is set lower than the resistance RB of the black-potential line LB (second potential line) (RW<RB), unlike the embodiment, the modifications, and the application examples.

Furthermore, although each of the embodiment, the modifications, and the application examples, for example, is a case where the plural types of potential lines are two types of potential lines which are the black-potential line LB maintained at a black gray-scale potential and the white-potential line LW maintained at a white gray-scale potential, it is not limited thereto. Three or more types of potential lines may be used for performing the image display.

Also, although each of the embodiment, the modifications, and the application examples, for example, is a case where the storage circuit in each pixel is configured of a SRAM circuit, it is not limited thereto. Other circuits such as a DRAM (Dynamic Random Access Memory) circuit may be used. Therefore, the present technology is applicable to any type of display devices in which the gray-scale of a display element is determined according to a potential selectively supplied from plural types of potential lines.

Further, the configurations described in the embodiment and the modifications, for example, may be combined in any combination.

Furthermore, although each of the embodiment, the modifications, and the application examples, for example, is a case where the display element in each pixel is the liquid crystal element LC (a case where a liquid crystal display device is employed), it is not limited thereto. Specifically, the display element may be configured by other display element such as an organic EL element (i.e., other display device using other display scheme may be employed). In an example where the organic EL element is used, the luminance gradient described above is determined by the relation between the applied voltage or the applied current and the display luminance, or between the applied voltage as well as the applied current and the display luminance. That is, it is possible to apply the present technology to an embodiment where other display element is used, by adjusting the resistance of each potential line in accordance with the relation between the gray-scale potential supplied from each potential line and the luminance gradient, in which the luminance gradient represents to the magnitude of the variation in the display luminance with respect to the variation in the voltage or the current applied to the display element, as in the embodiment, the modifications, and the application examples described above. The luminance of such display element may be determined according to a characteristic of the pixel of the display element, such as according to the emission intensity of each pixel in a light-emitting display device and according to the lightness of each pixel in an electrophoretic electronic paper.

It is possible to achieve at least the following configurations (1) to (13) from the above-described example embodiments, the modifications, and the application examples of the disclosure.

(1) A display device, including:

a plurality of pixels each including a display element;

a plurality of potential lines maintained at respective gray-scale potentials different from one another, the potential lines including first potential lines each maintained at a first gray-scale potential level allowing a luminance gradient to be relatively steep and second potential lines each maintained at a second gray-scale potential level allowing a luminance gradient to be relatively gentle, the luminance gradient representing a magnitude of a display luminance variation caused by a variation in a voltage or current applied to the display element; and a driving section performing display drive on the pixels based on an image signal, through supplying the display element of each of the pixels with a gray-scale potential level of selected one of the plurality of potential lines, wherein a resistance of the first potential line is lower than a resistance of the second potential line.

(2) The display device according to (1), wherein each of the first potential lines has a wiring width larger than a wiring width of each of the second potential lines.

(3) The display device according to (1) or (2), wherein one part or more of wiring of each of the first potential lines has a resistivity lower than a resistivity of the second potential line.

(4) The display device according to (3), wherein the first potential line includes:

a higher-resistivity wiring formed in a layer in which the second potential line is formed, and formed of a material same as a material of the second potential line; and one or more lower-resistivity wirings formed in a layer different from the layer in which the second potential line is formed, to be electrically connected to the higher-resistivity wiring, and formed of a material having a resistivity lower than the material of the second potential line.

(5) The display device according to (4), wherein the first potential lines includes a plurality of lower-resistivity wirings provided to be thinned out for the plurality of pixels.

(6) The display device according to (1), wherein the image signal is configured of a plurality of bits, each of the pixels includes a plurality of sub-pixels each having a display region with an area corresponding to a significance of corresponding bit of the image signal, and first potential lines are provided for the bits of the image signal, respectively, and second potential lines are provided for bits of the image signal, respectively, one of the first potential lines that corresponds to a higher-order bit of the image signal having a resistance equal to or lower than a resistance of another of the first potential lines that corresponds to a lower-order bit of the image signal, one of the second potential lines that corresponds to a higher-order bit of the image signal having a resistance equal to or lower than a resistance of another of the second potential lines that corresponds to a lower-order bit of the image signal.

(7) The display device according to (6), wherein the one of the first potential lines that corresponds to the higher-order bit of the image signal has a wiring width larger than a wiring width of said another of the first potential lines that corresponds to a lower-order bit of the image signal.

(8) The display device according to any one of (1) to (7), wherein the plurality of potential lines include black-potential lines each maintained at a black gray-scale potential level and white-potential lines each maintained at a white gray-scale potential level, and the driving section performs the display drive through supplying the display element with a gray-scale potential level selected from the black gray-scale potential level and the white gray-scale potential level.

(9) The display device according to (8), wherein the first potential lines are the black-potential lines and the second potential lines are the white-potential lines.

(10) The display device according to any one of (1) to (9), wherein each of the pixels further include a pixel circuit selectively determining a gray-scale potential level of the selected one of the plurality of potential lines based on the image signal, and supplying the determined gray-scale potential level to the corresponding display element.

(11) The display device according to (10), wherein the pixel circuit includes a storage circuit holding the image signal.

(12) The display device according to any one of (1) to (11), wherein the display element is a liquid crystal element.

(13) An electronic unit with a display device, the display device including:

a plurality of pixels each including a display element;

a plurality of potential lines maintained at respective gray-scale potentials different from one another, the potential lines including first potential lines each maintained at a first gray-scale potential level allowing a luminance gradient to be relatively steep and second potential lines each maintained at a second gray-scale potential level allowing a luminance gradient to be relatively gentle, the luminance gradient representing a magnitude of a display luminance variation caused by a variation in a voltage or current applied to the display element; and a driving section performing display drive on the pixels based on an image signal, through supplying the display element of each of the pixels with a gray-scale potential level of selected one of the plurality of potential lines, wherein a resistance of the first potential line is lower than a resistance of the second potential line.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A display device, comprising:

a plurality of pixels each including a display element;

a driving section including a scanning line driving circuit and a signal line driving circuit for performing display drive on the pixels based on an at least an image signal input from a signal line that is connected to the signal line driving circuit;

a plurality of potential lines including a first potential line and a second potential line, different gray-scale potentials being applied to the first potential line and the second potential line, respectively a pixel circuit configured to select one of the plurality of potential lines in response to the input signal from the signal line so that a first resistance of the first potential line that maintains at a first gray-scale potential level allows a first luminance gradient and is lower than a second resistance of the second potential line that is maintained at a second gray-scale potential level allowing a second luminance gradient that is less steep than that of the first luminance gradient, the luminance gradients representing a magnitude of a display luminance variation caused by a variation in a voltage or current applied to the display element, wherein the driving section performs display drive on the pixels based on the image signal input from the signal line, through supplying the display element of each of the pixels with a gray-scale potential level of selected one of the plurality of potential lines.

2. The display device according to claim 1, wherein each of the first potential lines has a wiring width larger than a wiring width of each of the second potential lines.

3. The display device according to claim 1, wherein one part or more of wiring of each of the first potential lines has a resistivity lower than a resistivity of the second potential line.

4. The display device according to claim 3, wherein the first potential line includes:

a higher-resistivity wiring formed in a layer in which the second potential line is formed, and formed of a material same as a material of the second potential line; and one or more lower-resistivity wirings formed in a layer different from the layer in which the second potential line is formed, to be electrically connected to the higher-resistivity wiring, and formed of a material having a resistivity lower than the material of the second potential line.

5. The display device according to claim 4, wherein the first potential lines includes a plurality of lower-resistivity wirings provided to be thinned out for the plurality of pixels.

6. The display device according to claim 1, wherein the image signal is configured of a plurality of bits, each of the pixels includes a plurality of sub-pixels each having a display region with an area corresponding to a significance of corresponding bit of the image signal, and first potential lines are provided for the bits of the image signal, respectively, and second potential lines are provided for bits of the image signal, respectively, one of the first potential lines that corresponds to a higher-order bit of the image signal having a resistance equal to or lower than a resistance of another of the first potential lines that corresponds to a lower-order bit of the image signal, one of the second potential lines that corresponds to a higher-order bit of the image signal having a resistance equal to or lower than a resistance of another of the second potential lines that corresponds to a lower-order bit of the image signal.

7. The display device according to claim 6, wherein the one of the first potential lines that corresponds to the higher-order bit of the image signal has a wiring width larger than a wiring width of said another of the first potential lines that corresponds to a lower-order bit of the image signal.

8. The display device according to claim 1, wherein the plurality of potential lines include black-potential lines each maintained at a black gray-scale potential level and white-potential lines each maintained at a white gray-scale potential level, and the driving section performs the display drive through supplying the display element with a gray-scale potential level selected from the black gray-scale potential level and the white gray-scale potential level.

9. The display device according to claim 8, wherein the first potential lines are the black-potential lines and the second potential lines are the white-potential lines.

10. The display device according to claim 1, wherein each of the pixels further include a pixel circuit selectively determining a gray-scale potential level of the selected one of the plurality of potential lines based on the image signal, and supplying the determined gray-scale potential level to the corresponding display element.

11. The display device according to claim 10, wherein the pixel circuit includes a storage circuit holding the image signal.

12. The display device according to claim 1, wherein the display element is a liquid crystal element.

13. An electronic unit comprising the display device according to claim 1.

14. A display device, comprising:

a plurality of pixels each including a display element;

a plurality of potential lines maintained at respective gray-scale potentials different from one another, the potential lines including first potential lines each maintained at a first gray-scale potential level allowing a luminance gradient to be relatively steep and second potential lines each maintained at a second gray-scale potential level allowing a luminance gradient to be relatively gentle, the luminance gradient representing a magnitude of a display luminance variation caused by a variation in a voltage or current applied to the display element; and a driving section performing display drive on the pixels based on an image signal, through supplying the display element of each of the pixels with a gray-scale potential level of selected one of the plurality of potential lines, wherein a resistance of the first potential line is lower than a resistance of the second potential line, one part or more of wiring of each of the first potential lines has a resistivity lower than a resistivity of the second potential line, and the first potential line includes:

a higher-resistivity wiring formed in a layer in which the second potential line is formed, and formed of a material same as a material of the second potential line; and one or more lower-resistivity wirings formed in a layer different from the layer in which the second potential line is formed, to be electrically connected to the higher-resistivity wiring, and formed of a material having a resistivity lower than the material of the second potential line.

15. The display device according to claim 14, wherein the first potential lines includes a plurality of lower-resistivity wirings provided to be thinned out for the plurality of pixels.

16. A display device, comprising:

a plurality of pixels each including a display element;

a plurality of potential lines maintained at respective gray-scale potentials different from one another, the potential lines including first potential lines each maintained at a first gray-scale potential level allowing a luminance gradient to be relatively steep and second potential lines each maintained at a second gray-scale potential level allowing a luminance gradient to be relatively gentle, the luminance gradient representing a magnitude of a display luminance variation caused by a variation in a voltage or current applied to the display element; and a driving section performing display drive on the pixels based on an image signal, through supplying the display element of each of the pixels with a gray-scale potential level of selected one of the plurality of potential lines, wherein a resistance of the first potential line is lower than a resistance of the second potential line, the image signal is configured of a plurality of bits, each of the pixels includes a plurality of sub-pixels each having a display region with an area corresponding to a significance of corresponding bit of the image signal, and first potential lines are provided for the bits of the image signal, respectively, and second potential lines are provided for bits of the image signal, respectively, one of the first potential lines that corresponds to a higher-order bit of the image signal having a resistance equal to or lower than a resistance of another of the first potential lines that corresponds to a lower-order bit of the image signal, one of the second potential lines that corresponds to a higher-order bit of the image signal having a resistance equal to or lower than a resistance of another of the second potential lines that corresponds to a lower-order bit of the image signal.

17. The display device according to claim 16, wherein the one of the first potential lines that corresponds to the higher-order bit of the image signal has a wiring width larger than a wiring width of said another of the first potential lines that corresponds to a lower-order bit of the image signal.

* * * * *